US005385501A

United States Patent [19]

Fish

[11] Patent Number: 5,385,501

[45] Date of Patent: Jan. 31, 1995

[54] AQUATIC TOY

[76] Inventor: Richard I. Fish, 6477 Robert St., West Palm Beach, Fla. 33413

[21] Appl. No.: 275,353

[22] Filed: Jul. 15, 1994

[51] Int. Cl.[6] ..... A63H 23/14

[52] U.S. Cl. ..... 446/154; 446/159

[58] Field of Search ..... 446/153, 154, 156, 159, 446/160, 163, 155; 440/42

[56] References Cited

U.S. PATENT DOCUMENTS

| | | | |
|---|---|---|---|
| 2,314,057 | 3/1943 | Slotsky et al. | 446/163 |
| 2,674,065 | 4/1954 | Sprinkle | 446/154 |
| 2,991,587 | 7/1961 | Blanchard | 446/154 |

*Primary Examiner*—Mickey Yu
*Attorney, Agent, or Firm*—Alvin S. Blum

[57] ABSTRACT

A toy floats on the water surface of a pool. A hydraulic jet propulsion unit is connected to the bottom face of the toy. The propulsion unit includes a rigid tubular member with a straight central portion, a forward right angle elbow and a rear exhaust tube extending at an acute angle to the central portion. The forward elbow is connected by a flexible hose tether to a water source. Thee hose is anchored at an intermediate point to the pool bottom. The rigid tubular member is rotatably mounted in a housing so that it is free to rotate about the long axis of its straight portion. Water forced through the rigid tubular member is ejected from the exhaust tube, forcing the toy forward. When the elbow is vertical, the toy moves straight forward. When the elbow is rotated to the left or right by the pull of the tether, the exhaust tube also rotates to left or right causing the exhaust jet to leave the stern at an angle, turning the toy as it moves forward. This creates automatic random forward propulsion with random left and right turns with various angles for an unusual and appealing continuous unattended operation.

8 Claims, 1 Drawing Sheet

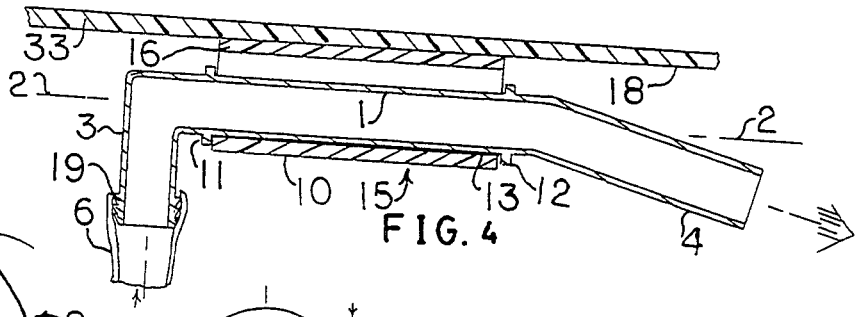
FIG. 4
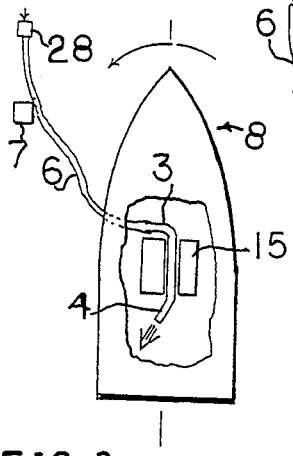
FIG. 2
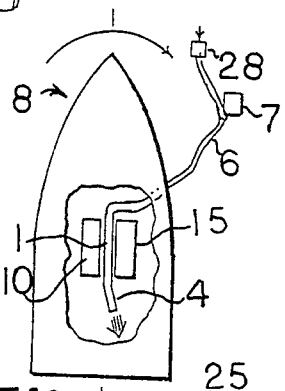
FIG. 1
FIG. 5
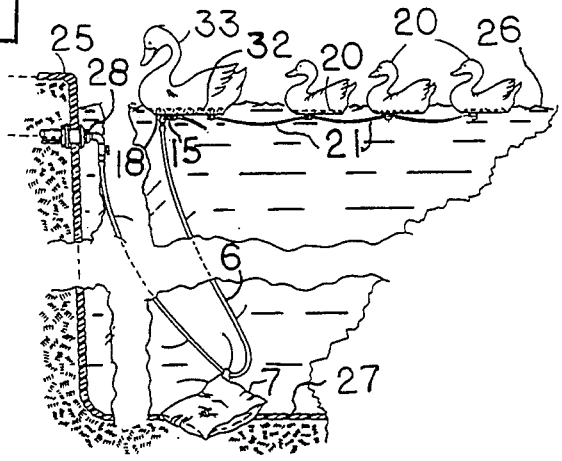
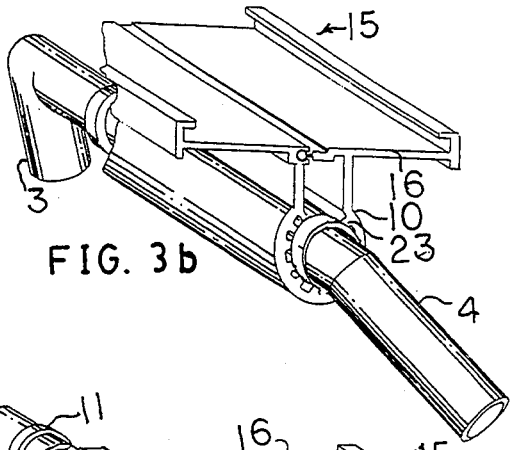
FIG. 3b
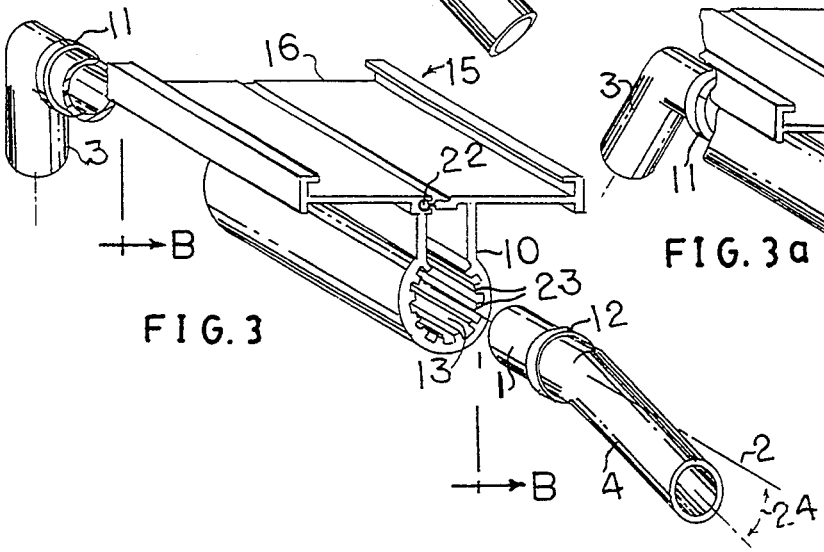
FIG. 3
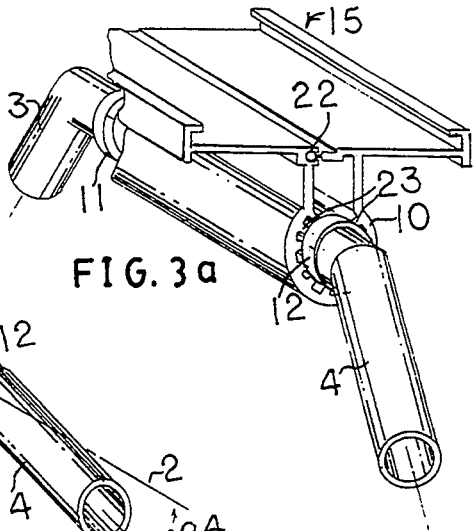
FIG. 3a

AQUATIC TOY

BACKGROUND OF THE INVENTION

This invention relates to aquatic toys and more particularly to toys floating in a swimming pool, connected to a water source and propelled about the water surface by a water jet.

Decorative buoyant toys including animals, boats, flowers and the like for floating in swimming pools, bathtubs, ponds and the like are well known. U.S. Pat. No. 2,674,065 issued Apr. b, 1954 to Sprinkle discloses such a floating toy in the form of a duck for bathtub which is provided with intermittent propulsion and other motions of jointed parts by a hydraulic motor powered by a hose connected to a supply of water under pressure. The hydraulic motor comprises intermittently opening kinks in a flexible tube within the body to provide intermittent motion to the jointed parts. A fixed exhaust tube extending rearward causes the duck to move forward in spurts while an upwardly directed supply tube provides periodic upward thrusts. This combination of forces provides a sobbing forward motion substantially in a straight line along the axis of the exhaust tube until the duck either hits the side of the tub or is restrained by the supply hose. If restrained by the supply hose, the resultant motions and positions may be very erratic and certainly not characteristic of a duck. If left unattended, the toy will soon be trapped against a side of the tub or stopped at the hose end in an unappealing condition. For use in a swimming pool where it will be unattended for long periods, this would not satisfy most decorative requirements of such a toy.

SUMMARY OF THE INVENTION

It is accordingly an object of the invention to provide a floating toy provided with hydraulic propulsion through a hose/tether in which the resulting motion will be realistic and continuous while unattended. It is another object to provide an automatic smooth turning motion with random turns generated by the tether.

The aquatic toy of the invention comprises a floating figure arranged to float upon the surface of a body of water. Mounted pivotably underneath the figure is a rigid tube with a long axis aligned with the forward-to-rearward axis of the figure. The forward end of the tube is bent at a right angle to the long axis and terminates in a connection to a flexible elongate hose which is connected to a pressurized water source. The hose is anchored to the bottom of the body of water at an intermediate point thereof. The rigid tube is free to pivot about its long axis as the toy moves about relative to the anchor and the hose pulls the forward end of the tube in various directions. At the rear end of the rigid tube is an ejection passage extending at an angle to the long axis. As water passe s through the hose and through the tube, it is ejected forcefully from the ejection passage, moving the figure forward by jet propulsion. The forward movement will be straight ahead or curving to left or right as the toy moves about and the anchored hose pulls the angled front end of tube in various directions, causing the ejection passage to rotate correspondingly. The result is that the toy moves randomly and continuously on the surface, making various graceful turns and never straying beyond the limits defined by the tethering hose even when unattended.

These and other objects, advantages and features of the invention will become more apparent when the detailed description is studied in conjunction with the drawings.

BRIEF DESCRIPTION OF THE DRAWINGS

FIG. 1 is a diagrammatic plan view of a toy of the invention turning clockwise.

FIG. 2 is a diagrammatic plan view of the toy of FIG. 1 turning counterclockwise.

FIG. 3 is a perspective view of the hydraulic motion assembly of a toy of the invention in forward direction condition.

FIG. 3*a* is a perspective view as in FIG. 3 in counterclockwise direction condition.

FIG. 3*b* is a perspective view as in FIG. 3 in clockwise direction condition.

FIG. 4 is a sectional view taken on line B—B of FIG. 3.

FIG. 5 is a perspective view of a floating toy of the invention.

DETAILED DESCRIPTION OF PREFERRED EMBODIMENTS

Referring now first to FIGS. 3–5, a floating duck 33 may be a hollow plastic or rigid foam figure that floats upon the surface 26 of swimming pool 25. It may have weighting material 32 to maintain upright position. Floating baby ducks 20 are connected by flexible cords 21 so that the babies will follow the parent duck in a natural swimming behavior. The parent duck 33 has a hydraulic propulsion assembly 15 attached to its bottom face 18. The hydraulic assembly 15 comprises a housing or mounting 10 attached by connecting plate 16 to the underside 18 of the toy. The housing 10 has a cylindrical channel 13 which may be provided with friction-reducing ribs 23. Within the channel 13 is pivotally mounted rigid cylindrical tube 1 having a long axis 2 about which the tube 1 pivots freely in the channel 13. The forward end of the tube 1 connects at a right angle to a short rigid passage 3 to which a flexible hose 6 is attached at hose connection 19. This hose is long and thin. It is anchored at an intermediate point by anchor means 7, such as a sandbag, to the bottom 27 of swimming pool 25 to tether the toy in a range around the anchor. A source of pressurized water 28 is connected to the end of hose 6 so that water passes through elbow 3, and then tube 1. An exhaust passage 4 at the downstream end of tube 1 is set at an angle 24 of between 80 degrees and 2 degrees to axis 2 of the tube 1, with a preferred angle of less than 30 degrees. The central axes of all three passages lie in a common plane for best results for equal turning in both clockwise and counterclockwise direction. FIG. 3 shows the assembly with the front passage 3 vertical. In this condition, the exhaust tube is directed backward from the toy. Reaction forces from this jet moves the toy straight forward. FIG. 3*a* shows the front passage 3 pointing to the left. This is caused by the anchor being to the left of the toy, thereby rotating tube 1 in the cylindrical channel 13. This moves exhaust jet 4 to the left, turning the toy counterclockwise as well as forward. FIG. 3*b* shows the opposite condition, when the anchor is to the right of the toy. As the rigid elbow 3 rotates from left to right, the turning angle gradually diminishes and then reverses and slowly increases, so that a smooth changing of directions and random straight ahead and left and right turns occurs automatically without any operator requirements. The angle and length of the exhaust tube, the flow rate and tube diameter as well as the fore and aft location of assembly 15 on the floating toy may all be adjusted as desired. A weighted material 32 may be deposited within or below the floating figures for upright positioning or the underwater attachments may be provided with the necessary weights.

The collars or shoulders 11 and 12 hold the straight tube 1 within the cylindrical passage 13 of housing 10 while enabling free rotation. The snap together joint 22 in connection plate 16 enables the collars 11 and 12 to be installed and the completed rigid assembly then inserted into the open cylindrical channel and then the channel snapped closed. At the same time this may provide a means for enabling the connecting plate 16 to grasp the sides of the floating toy. Various other means for attaching the floating figure, removable or permanent, well known in the art may be employed as well. In FIG. 3 the movable assembly is shown broken away at the tube 1 and pulled out of cylindrical channel 13 only for illustration. FIGS. 3*a* and 3*b* show the assembly 16 in operating condition.

The floating toy may be any figure, real or imaginary creature or object. The figure may itself be buoyant, or it may be mounted on a buoyant element. FIGS. 1 and 2 show a toy boat 8 of the invention in which the center portion has been broken away to reveal the hydraulic propulsion unit 15 attached to the bottom of the boat. In FIG. 1 the anchor 7 is to starboard, rotating forward elbow 3 to starboard by tension on hose 6. This rotates exhaust tube 4 to starboard and exhaust jet to right of centerline 9 forces the boat forward and into a turn to starboard. The converse is the case with FIG. 2.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. For floating and automatically moving about upon the surface of a body of water, said body of water having a bottom and a supply of water under pressure, a tethered floating toy comprising:

A) a figure having an upper portion arranged to float above said surface, and a lower portion arranged to lie below said surface, said lower portion having a bottom face;

B) an elongate flexible tubular tether means for tethering said toy, said tether means having a first terminus connectable to said supply of water, an intermediate portion provided with anchor means for holding said intermediate portion, at one point thereof, immovable on the bottom of said body of water, and a second terminus;

C) a rigid tubular member having a first passage extending along a first axis and a second passage extending along a second axis transverse to said first axis, said first and second passages in fluid communication at a first end of each passage, said first passage having a second end extending along a third axis at an angle to said first axis, wherein said first, second and third axes lie substantially in a common plane;

D) means for connecting a second end of said second passage in fluid communication with said second terminus of said tether means; and E) mounting means for pivotably connecting the bottom face of said figure to said tubular member with said first axis arranged substantially parallel to a forward-to-rearward axis of said figure, with said second end of said first passage extending rearward so as to enable said tubular member to rotate about said first axis, and said third axis to rotate relative to said forward-to-rearward axis to propel said figure in various directions when water under pressure is ejected from said second end as forces from said tether means move said second passage in various directions.

2. The toy according to claim 1, in which said figure is a simulated animal, real or imaginary.

3. The toy according to claim 1, in which said figure is a vehicle.

4. The toy according to claim 1, further comprising at least one additional floating figure attached at a forward end thereof by elongate flexible connecting means to a rearward portion of said figure.

5. The toy according to claim 1, in which said mounting means is arranged for removably connecting to said figure.

6. The toy according to claim 1, further comprising at least one additional floating figure attached at a forward end thereof by elongate flexible connecting means to a rearward portion of said mounting means.

7. The toy according to claim 1, in which said mounting means has a negative buoyancy.

8. The toy according to claim 1, in which said mounting means has a positive buoyancy.

* * * * *